US007832326B1

(12) United States Patent
Barrett

(10) Patent No.: US 7,832,326 B1
(45) Date of Patent: Nov. 16, 2010

(54) AUTO-LOADING FIREARM WITH GAS PISTON FACILITY

(76) Inventor: Christopher Gene Barrett, 8634 E. Gum Rd., Murfreesboro, TN (US) 37127

( * ) Notice: Subject to any disclaimer, the term of this patent is extended or adjusted under 35 U.S.C. 154(b) by 749 days.

(21) Appl. No.: 11/788,224

(22) Filed: Apr. 18, 2007

(51) Int. Cl.
*F41A 5/18* (2006.01)

(52) U.S. Cl. ..... 89/191.01; 89/193; 42/95

(58) Field of Classification Search ..... 89/191.01, 89/191.02, 192, 193, 194, 156, 159, 179; 42/95

See application file for complete search history.

(56) References Cited

U.S. PATENT DOCUMENTS

| | | | | | |
|---|---|---|---|---|---|
| 3,982,468 | A * | 9/1976 | Browning | ..... | 89/193 |
| 3,990,347 | A * | 11/1976 | Junker | ..... | 89/185 |
| 4,244,273 | A * | 1/1981 | Langendorfer et al. | ..... | 89/193 |
| 4,324,170 | A * | 4/1982 | Healy | ..... | 89/159 |
| 5,351,598 | A * | 10/1994 | Schuetz | ..... | 89/185 |
| 6,848,351 | B1 * | 2/2005 | Davies | ..... | 89/191.01 |
| 7,461,581 | B2 * | 12/2008 | Leitner-Wise | ..... | 89/191.01 |
| 2007/0199435 | A1 * | 8/2007 | Hochstrate et al. | ..... | 89/191.02 |
| 2008/0276797 | A1 * | 11/2008 | Leitner-Wise | ..... | 89/191.01 |
| 2009/0223357 | A1 * | 9/2009 | Herring | ..... | 89/192 |

* cited by examiner

*Primary Examiner*—Benjamin P Lee
(74) *Attorney, Agent, or Firm*—Bennet K. Langlotz; Langlotz Patent & Trademark Works, Inc.

(57) ABSTRACT

A firearm has a body with a bolt assembly reciprocating within the body. A barrel having a bore extends from the body. A gas block with an elongated chamber is connected to the barrel, and a gas passage connects the barrel bore to the gas block chamber. An operating rod has a forward end portion closely received in the gas block chamber and a rear end positioned to operably engage the bolt assembly. The gas block chamber has a forward portion closely receiving the forward end portion of the rod, and the gas block chamber has a rear portion with a profile larger than the forward portion. The forward portion of the rod may be a cylinder, and the rear portion of the gas block chamber may be fluted to provide clearance for flushing out contaminants. The rod may rotate freely to prevent accumulation of contaminants.

18 Claims, 5 Drawing Sheets

AUTO-LOADING FIREARM WITH GAS PISTON FACILITY

FIELD OF THE INVENTION

This invention relates to firearms, and more particularly to self-loading firearms including machine guns.

BACKGROUND AND SUMMARY OF THE INVENTION

Auto-loading rifles generally employ the energy produced in firing a round to cycle a bolt assembly (bolt carrier and bolt) and load the next round. This includes machine guns and semi-automatic rifles and handguns of many types.

One type of system for transferring energy to the bolt employs the gas pressure developed behind the bullet in the barrel upon discharge. This is know as a direct-gas operated system. A small lateral vent hole is provided in the barrel (usually at a forward location), and the momentary gas pressure is transmitted through the vent hole back to the bolt assembly to cycle it. In direct-gas-operated rifles (such as an M16 or M4 rifle) the gas pressure is transmitted via a tube that extends back to the bolt, which has a piston-like portion to which the gas imparts pressure. In others (such as an M14) the gas pressure enters a cylindrical chamber, where a piston connected via a rod transmits the force back to the bolt assembly. This may either push the bolt assembly so that the rod and bolt assembly initially move together, or the rod may "tap" the bolt assembly, providing an impulse to move the bolt assembly rearward in its cycle.

A significant concern with all types of direct-gas-operated rifles is the fouling caused by the carbon and other contaminants generated during firing. The combustion gas used to cycle the action contains sooty particles that tend to coat the surfaces they contact. In a gas-operated system, this gas is exhausted into the action, so that the bolt assembly and trigger mechanism may become fouled, and so that the chamber into which cartridges are loaded becomes coated with the contaminants. This reduces dimensions, and increases friction, leading to stoppages caused by failures to chamber a round, and failures to extract spent casings.

In piston-operated systems, the action remains free of gas fouling, but the piston itself becomes fouled. The piston requires a close fit in the gas cylinder, and fouling tends to accumulate on the cylinder and piston surfaces, creating excess friction and interference that can prevent operation. Because the chamber formed by the cylinder is essentially a dead-end that does not let the gas and particles flow through, the fouling tends to accumulate there, maximizing the problem.

The fouling generated by either gas system is stubborn in its resistance to cleaning, which creates a significant regular cleaning chore, especially for military troops in the field.

The present invention overcomes the limitations of the prior art by providing a firearm having a body with a bolt assembly reciprocating within the body. A barrel having a bore extends from the body. A gas block with an elongated chamber is connected to the barrel, and a gas passage connects the barrel bore to the gas block chamber. An operating rod has a forward end portion closely received in the gas block chamber and a rear end positioned to operably engage the bolt assembly. The gas block chamber has a forward portion closely receiving the forward end portion of the rod, and the gas block chamber has a rear portion with a profile larger than the forward portion. The forward portion of the rod may be a cylinder, and the rear portion of the gas block chamber may be fluted to provide clearance for flushing out contaminants. The rod may rotate freely to prevent accumulation of contaminants.

DETAILED DESCRIPTION OF A PREFERRED EMBODIMENT

Figure 1:
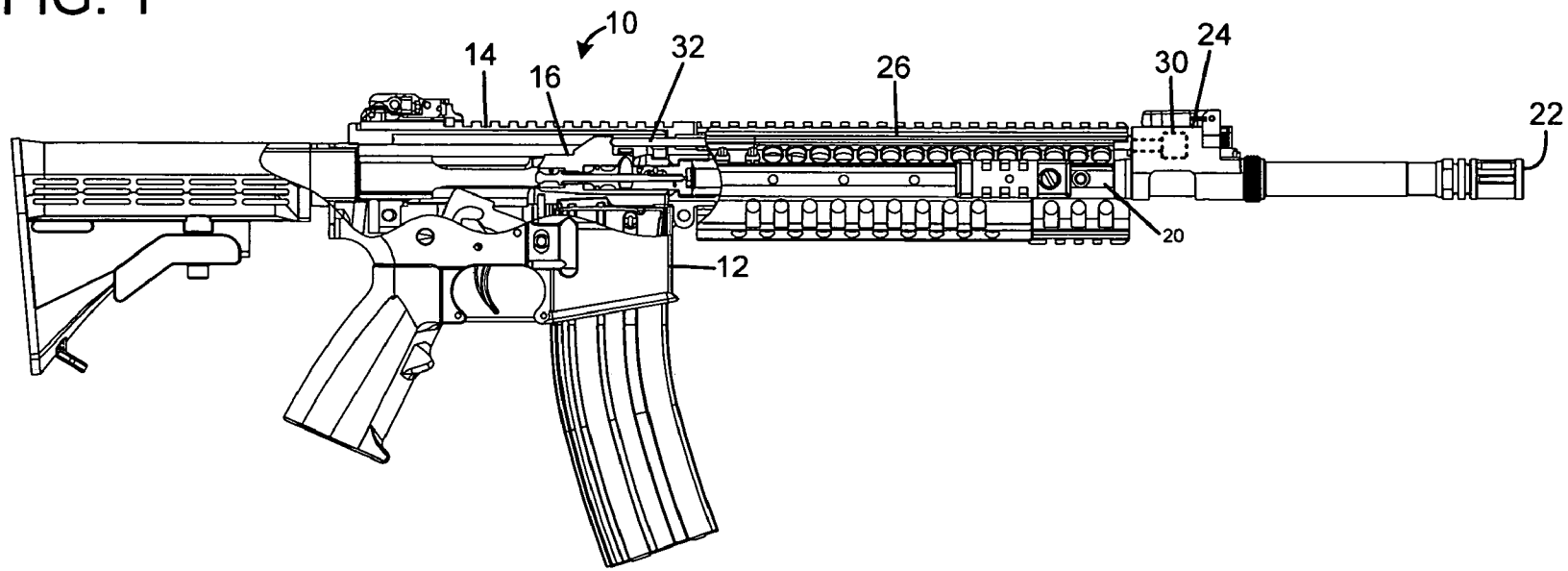
FIG. 1 is a side view of a rifle according to a preferred embodiment of the invention.

FIG. 1 shows a rifle 10 having a lower receiver 12, and an upper receiver 14 in which a bolt assembly 16 reciprocates. A barrel 20 extends forward from the upper receiver to a muzzle end 22. A gas block 24 is mounted to the barrel at an intermediate position near the muzzle. An operating rod 26 has a cylindrical piston 30 at a forward end, and has a rear end 32 that extends into the upper receiver 14, and which is registered with a portion of the bolt assembly 16. As will be discussed below, the piston 30 is closely received within a cylindrical bore in the gas block, and a passage extends between the cylinder and the barrel bore. Upon firing, some of the pressurized column of gas behind the bullet enters the gas block chamber and forces the piston rearward. The rod then transmits energy to the bolt assembly, cycling it rearward to load another round.

Figure 2:
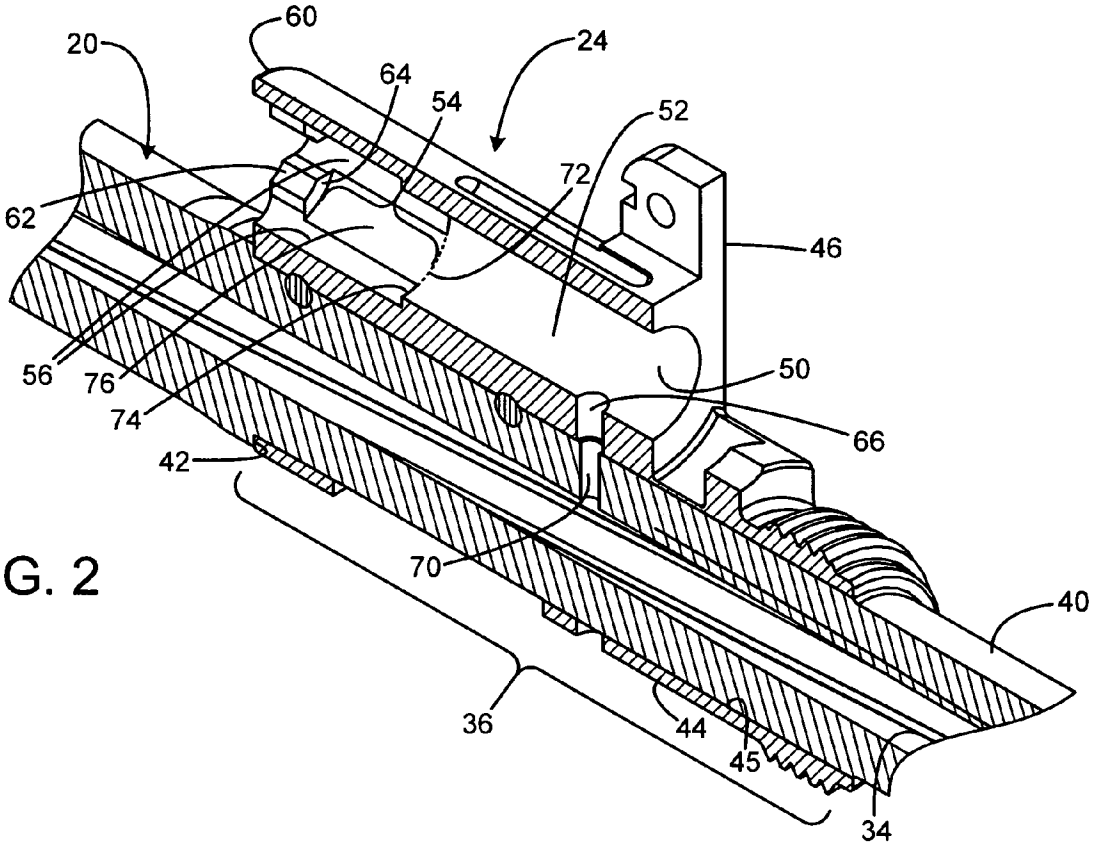
FIG. 2 is a sectional view of a gas block portion of the rifle of the preferred embodiment.
Figure 3:
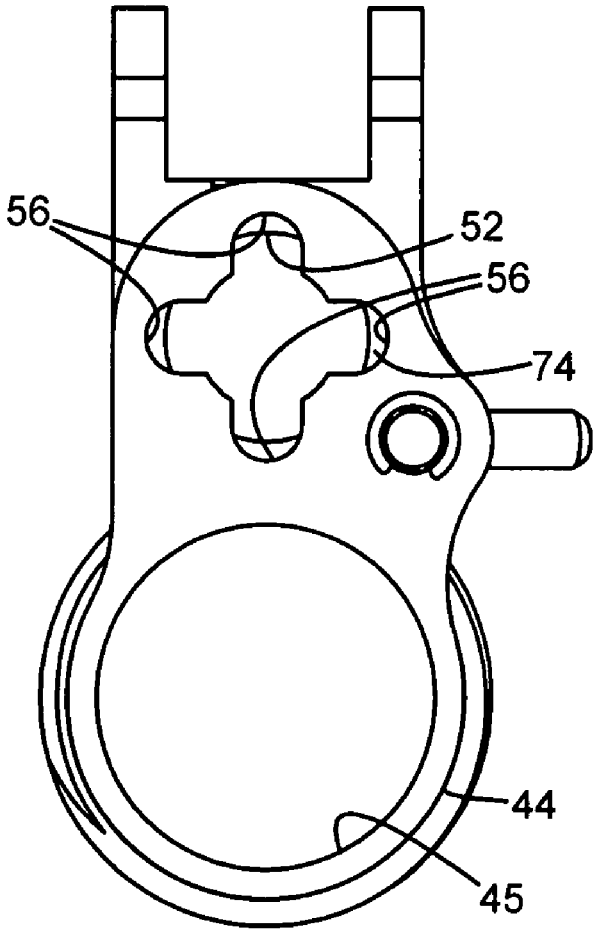
FIG. 3 is a rear end view of the gas block of the preferred embodiment.

FIGS. 2 and 3 show the gas block 24 as mounted on the barrel 20. The barrel bore 34 extends axially through the barrel. The barrel has an enlarged cylindrical profile portion 36 with a narrower portion 40 extending forward. At the rear of the cylindrical portion 36, a shoulder 42 is provided. The gas block 24 includes a cylindrical sleeve portion 44 defining a bore 45 that is sized for a tight press fit or low-clearance slip fit on the barrel portion 36, and has a comparable length. An upper block portion 46 extends above the sleeve portion and defines a generally cylindrical bore 50 providing a passage through the block parallel to the barrel bore.

The gas block passage 50 includes a forward portion 52 that is a straight cylindrical bore with a circular cross-section. Rearward of portion 52 is a fluted portion 54 having several axial channels or flutes 56 that extend out the rear end 60 of the gas block. The rearmost portion of the passage 50 is a shoulder portion 62 through which the flutes past, but with reduced diameter sections providing shoulders 64 that face forward. A gas passage aperture 66 is drilled laterally through the gas block toward the forward end of portion 52, and aligns with a gas passage 70 drilled in the barrel to provide communication between the barrel bore 34 and the gas block chamber.

The flutes 56 extend forward to a limit line 72 that defines the limit between the forward portion 52 and rear portion 54 of the gas block chamber. Each flute terminates at a flat surface 74 having an edge that follows the limit line 72. As shown in FIG. 3, the flutes 56 extend radially to a significantly larger diameter than the diameter of cylindrical section 52. In the preferred embodiment, the cylinder portion 52 has a diameter of 0.452 inch, and each flute extends radially beyond that by a distance of 0.042 inch. The reduced diameter at the shoulder portion 62 is 0.3126 inch. The flutes are generally semi cylindrical channels, so that they do not have any sharp internal corners that would be susceptible to fouling, and further to facilitate machining by conventional processes. The rear portion 54 of the gas block chamber includes cylindrical segments 76 that have the same diameter as the forward portion 52 and are smoothly continuous therewith. Thus, the cylindrical segment 76, and flutes 56 alternate in a rotationally symmetrical pattern as shown. In the preferred embodiment, there are four flutes and four cylindrical segments 76.

Figure 4:
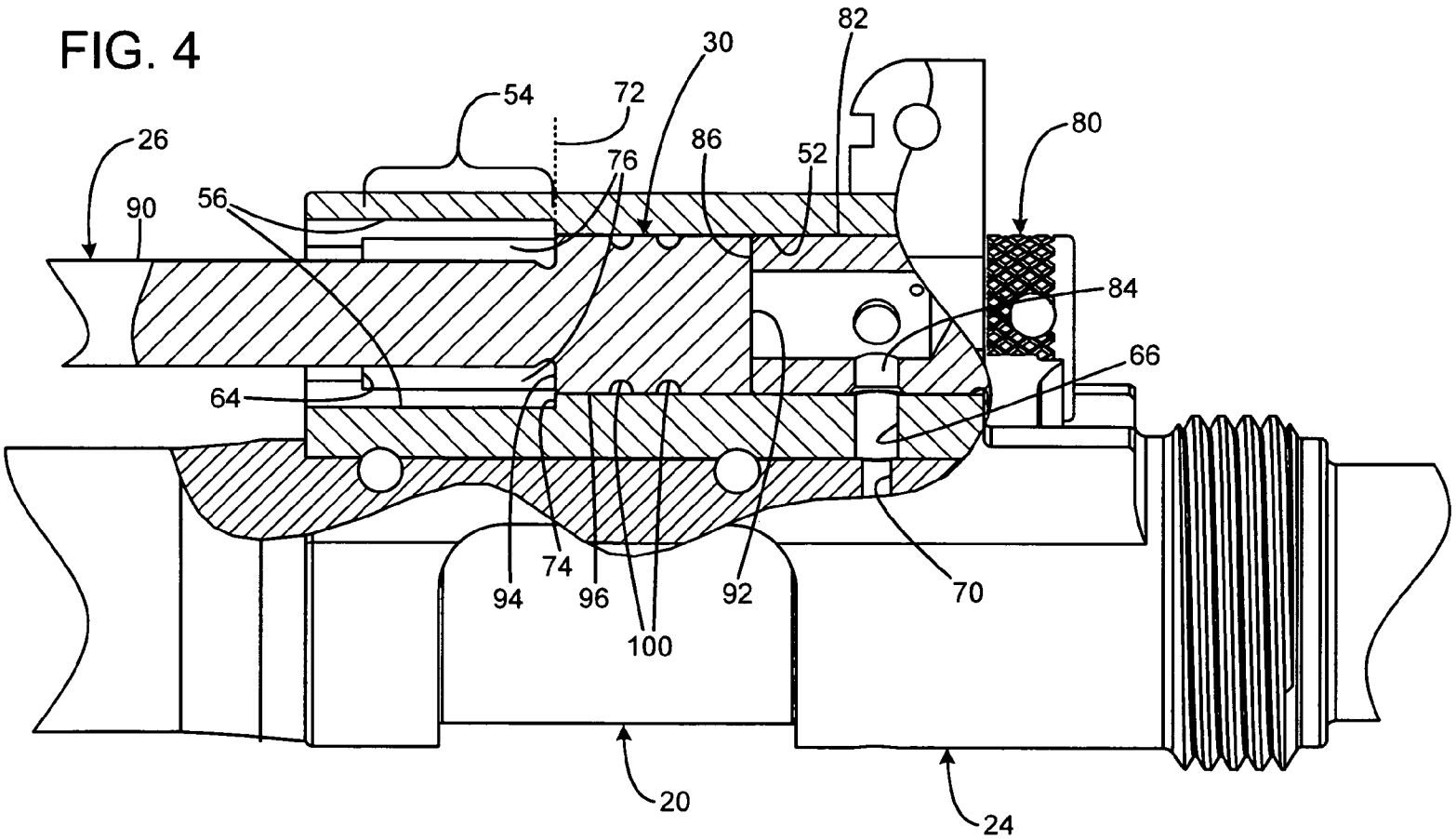
FIG. 4 is an enlarged side view of the preferred embodiment in a first operational condition.

As shown in FIG. 4, a forward gas plug 80 encloses the forward end of the gas block chamber. The plug has a cylindrical sleeve 82 that extends into the forward end of the chamber, and closely fits to seal against gas escape while permitting rotation. The sleeve has a lateral aperture 84 that may be registered with the gas hole 66 as shown to permit gas to be transmitted from the barrel bore into the chamber. The sleeve has a rear end face 86 that is flat, and perpendicular to the axis of the gas block chamber. The gas block may be provided with several different diameter apertures, so that an aperture appropriate for the circumstances may be selected. For instance, a larger aperture provides greater gas flow and therefore a greater impulse to the operating rod, while a smaller aperture reduces the force of the operating rod. The gas plug may also have a position in which no hole registers with the gas hole 66 so that the action does not cycle with each shot.

The operating rod 26 has a straight rigid elongated shank 90 having a limited diameter that readily passes through the limited aperture defined by the shoulder segment faces 62, with at least some limited clearance as illustrated. The forward end of the rod terminates with the enlarged piston 30, which has a flat circular front face 92 and a flat annular rear shoulder 94. the lateral cylindrical surface 96 of the piston is a smooth straight circular cylinder that closely fits within a cylindrical section 52 of the gas block chamber. A pair of circumferential annular grooves 100 encircles the piston at an intermediate position, spaced apart from each other. These provide a reservoir where minor fouling can accumulate without causing problems, and have edges that serve to scrape the interior of the gas block chamber as the piston cycles.

In FIG. 4, the piston is shown in a forward position to which it is normally spring biased. The face 92 of the piston abuts the rear face 86 of the plug, and the entire piston is surrounded by the forward portion 52 of the chamber. In the illustrated embodiment, the rear shoulder 94 of the piston aligns with the plane 72 defined by the forward end faces 74 of flutes 56, although this may vary as discussed below.

Figure 5:
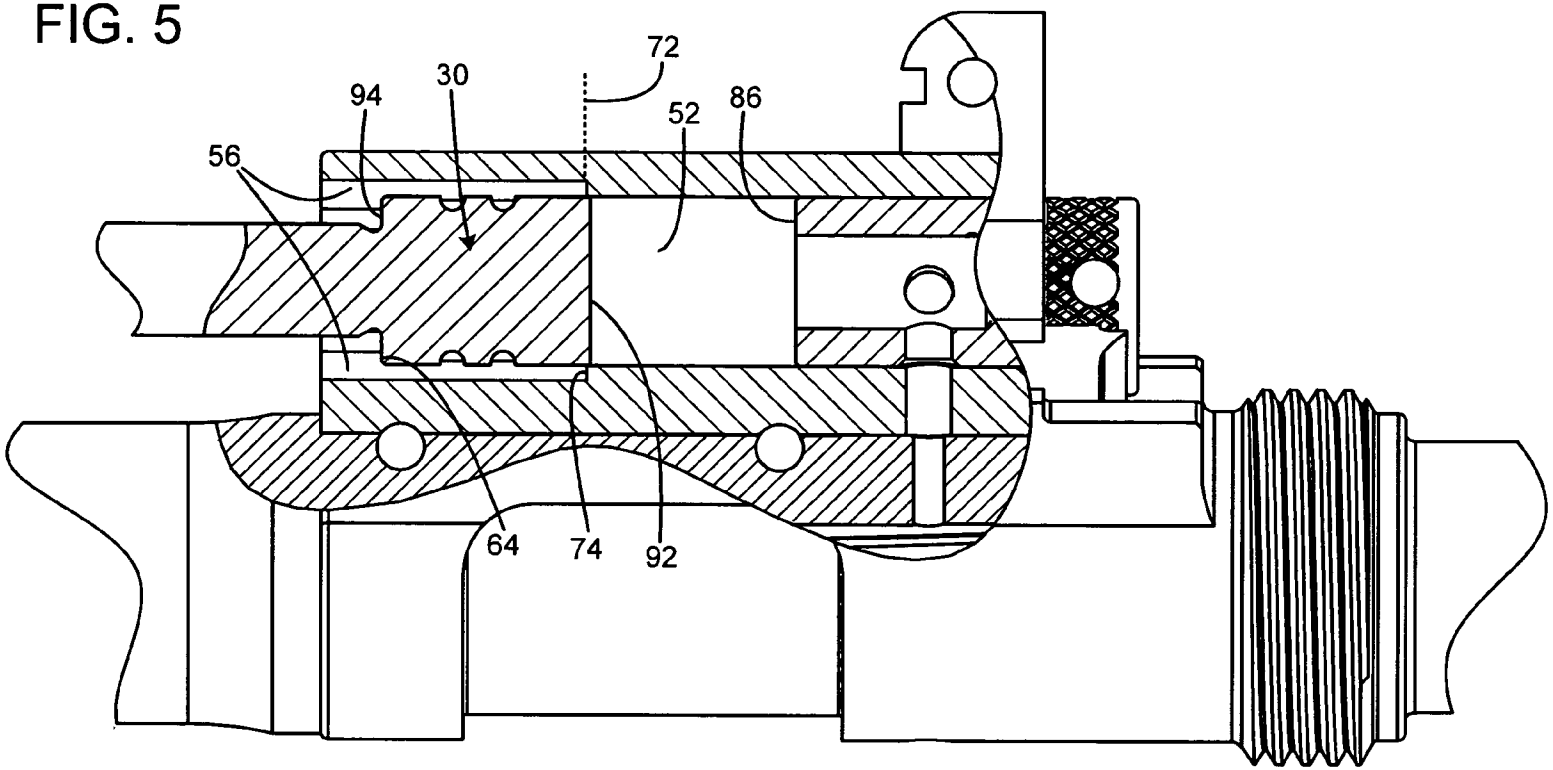
FIG. 5 is an enlarged side view of the preferred embodiment in a second operational condition.

In FIG. 5, the piston 30 is in a rearmost position in which the rear shoulder 94 abuts the shoulder 64 of the gas block. Because the length of the piston (0.550 inch in the preferred embodiment) is slightly greater than the distance between the shoulder 64 and the flute end face 74 (0.540 inch in the preferred embodiment) the face 92 of the piston never moves rearward far enough to expose the flutes 56. Consequently, the gas piston retains gas pressure in the chamber 52, so that it does not escape rearwardly toward the shooter. Instead, the gas pressure dissipates back through a gas hole through which it entered. An external vent providing communication with the atmosphere may also be provided in the gas block.

The flutes 56 provide that portions of the piston running nearly its entire length are exposed when the piston is in the rearward position. This permits any accumulated debris or fouling to be readily shed each time the piston cycles. Because the piston is free to rotate, different portions of the piston service are exposed during operation, so that any localized fouling build up is readily shed.

In alternative embodiments, the relationship between the plane 72 and the forward face of the piston while in the rearward position may be varied. Instead of the face being slightly forward of the end of the flutes, the face may be aligned precisely with the ends of the flutes, or may even be positioned slightly rearward of the flute ends. This may be desirable in circumstances in which gas needs to be vented rearward. This may be desired because atmospheric vents on the gas block can create a visible jet that can be seen in darkness. Exposed vents can also burn the user is the jet is adjacent to exposed skin. In the illustrated embodiment, the rearward venting path extends into a protected space within the shrouded handguard that surrounds the barrel to the rear of the gas block, preventing exposure and visibility of the vented gases.

While the above is discussed in terms of preferred and alternative embodiments, the invention is not intended to be so limited.

The invention claimed is:

1. A firearm comprising;

a body;

a bolt assembly reciprocating within the body;

a barrel defining a bore and extending from the body;

a gas block defining an elongated chamber and connected to the barrel;

the gas block and barrel defining a gas passage communicating between the barrel bore and the gas block chamber;

an operating rod having a piston at a forward end portion closely received in the gas block chamber and a rear end positioned to operably engage the bolt assembly;

the piston having a front end and a rear end;

the gas block chamber having a forward portion closely receiving the forward end portion of the rod;

the gas block chamber having a rearward portion with a profile along its length that is wider than the forward portion;

the forward and rearward portions of the chamber being separated at a limit line;

wherein the piston moves in a forward direction from a larger portion of the chamber to a position within a narrower portion of the chamber;

wherein when the piston is in the forward most position, the rear end of the piston is approximately aligned with the limit line; and wherein when the piston is in the rearward most position, the front end of the piston is aligned with or slightly forward of the limit line.

2. The firearm of claim 1 wherein the rod is operable to reciprocate between a forward limit position and a rearward limit position, and wherein the gas passage is defined in the gas block at a position forward of the rod when the rod is in the forward position, such that gas pressure in the barrel from discharging the firearm is transmitted to the forward portion of the chamber to force the operating rod rearward to operate the bolt assembly.

3. The firearm of claim 1 wherein the forward portion of the gas block chamber is a smooth cylindrical bore.

4. The firearm of claim 1 wherein the rear portion of the gas block chamber is fluted.

5. The firearm of claim 1 wherein the rear portion of the gas block chamber includes guide surfaces that closely receive the forward end portion of the rod, and clearance portions that are spaced apart from the forward end portion of the rod.

6. The firearm of claim 5 wherein the clearance portions extend from a rear limit of the forward portion of the gas block chamber.

7. The firearm of claim 5 wherein the clearance portions extend to a rear end of the gas block.

8. The firearm of claim 5 wherein the clearance portions are elongated channels that alternate with the guide surfaces.

9. The firearm of claim 1 wherein the rod is free to rotate with respect to the gas block.

10. A firearm comprising;

a body;

a bolt assembly reciprocating within the body;

a barrel defining a bore and extending from the body;

a gas block defining an elongated chamber and connected to the barrel;

the gas block and barrel defining a gas passage communicating between the barrel bore and the gas block chamber;

an operating rod having a piston at a forward end portion closely received in the gas block chamber and a rear end positioned to operably engage the bolt assembly;

the piston having a front end and a rear end;

the gas block chamber having a forward portion and a rearward portion;

the rearward portion having a profile along its length that is wider than the forward portion;

the forward and rearward portions of the chamber being separated at a limit line;

the piston being operable to reciprocate between a forward limit position and a rearward limit position, and wherein the gas passage is defined in the gas block at a position forward of the rod when the rod is in the forward position, such that gas pressure in the barrel from discharging the firearm is transmitted to the forward portion of the chamber to force the operating rod rearward to operate the bolt assembly;

the gas block chamber having an interior surface closely receiving the forward end portion of the rod when the rod is in the forward limit position;

the interior surface exposing a substantial portion of the forward portion of the rod when the rod is in the rearward limit position;

wherein the piston moves in a forward direction from a larger portion of the chamber to a position within a narrower portion of the chamber;

wherein when the piston is in the forward most position, the rear end of the piston is approximately aligned with the limit line; and wherein when the piston is in the rearward most position, the front end of the piston is aligned with or slightly forward of the limit line.

11. The firearm of claim 10 wherein the forward end portion of the rod has a forward peripheral edge that is closely encompassed by the gas block chamber when the rod is in the rearward limit position.

12. The firearm of claim 10 wherein the gas block chamber has a forward portion that is a smooth cylindrical bore.

13. The firearm of claim 10 wherein a rear portion of the gas block chamber is fluted.

14. The firearm of claim 10 wherein a rear portion of the gas block chamber includes guide surfaces that closely receive the forward end portion of the rod, and clearance portions that are spaced apart from the forward end portion of the rod.

15. The firearm of claim 14 wherein the clearance portions extend from a rear limit of the forward portion of the gas block chamber.

16. The firearm of claim 14 wherein the clearance portions extend to a rear end of the gas block.

17. The firearm of claim 14 wherein the clearance portions are elongated channels that alternate with the guide surfaces.

18. The firearm of claim 10 wherein the rod is free to rotate with respect to the gas block, such that different portions of the forward portion of the rod are exposed when the rod is in different rotational positions.

* * * * *